United States Patent [19]

Baun

[11] Patent Number: 5,071,072

[45] Date of Patent: Dec. 10, 1991

[54] PILOT CONTROLLED LIQUID ACTUATED COOLANT CONTROL VALVES

[76] Inventor: Daniel Baun, 696 McClurg Rd., Boardman, Ohio 44512

[21] Appl. No.: 621,855

[22] Filed: Dec. 4, 1990

[51] Int. Cl.[5] ..... B05B 1/14

[52] U.S. Cl. ..... 239/551; 137/883; 137/884; 251/30.01; 251/30.02

[58] Field of Search ..... 239/551, 562; 137/883–885; 251/30.01–30.05

[56] References Cited

U.S. PATENT DOCUMENTS

| | | | |
|---|---|---|---|
| 3,145,967 | 8/1964 | Gardner | 251/30.05 X |
| 3,159,374 | 12/1964 | Kroffke | 251/30.05 |
| 3,556,144 | 1/1971 | Bickers et al. | 137/884 X |
| 3,903,919 | 9/1975 | Zeuner | 251/30.03 X |
| 3,905,575 | 9/1975 | Zeuner et al. | 251/30.02 |
| 4,247,047 | 1/1981 | Schaming | 239/551 X |
| 4,305,566 | 12/1981 | Grawunde | 251/30.02 |
| 4,360,037 | 11/1982 | Kendall | 251/30.05 X |
| 4,387,739 | 6/1983 | Schaming | 239/551 X |
| 4,568,026 | 2/1986 | Baun | 239/551 |
| 4,586,531 | 5/1986 | Lindell | 137/885 X |
| 4,697,619 | 10/1987 | Tiefenthaler | 251/30.02 X |
| 4,723,575 | 2/1988 | Kazita et al. | 137/883 |
| 4,733,696 | 3/1988 | Baun | 137/883 |
| 4,733,697 | 3/1988 | Baun | 137/884 |
| 4,896,692 | 1/1990 | Baun | 251/30.02 X |
| 4,981,280 | 1/1991 | Brandenberg | 251/30.02 X |

FOREIGN PATENT DOCUMENTS

| | | | |
|---|---|---|---|
| 196475 | 10/1985 | Japan | 251/30.02 |

*Primary Examiner*—Andres Kashnikow
*Assistant Examiner*—Lesley D. Morris
*Attorney, Agent, or Firm*—Harpman & Harpman

[57] ABSTRACT

A plurality of pilot controlled liquid operated coolant control valves are mounted in a section of a manifold for actuation by fluid pressure of coolant in said manifold as controlled by solenoid operated pilot valves controlling the fluid pressure operation of the coolant control valves. The manifold and its valve assemblies are positioned adjacent the work and backup rolls of a rolling mill for supplying coolant to said rolls in desirable spray patterns covering the surfaces of the rolls and operable only when the rolling mill is functioning normally.

8 Claims, 4 Drawing Sheets

PILOT CONTROLLED LIQUID ACTUATED COOLANT CONTROL VALVES

BACKGROUND OF THE INVENTION

1. Technical Field:

This invention relates to rolling mills in general and more particularly to rolling mills where aluminum is being reduced to thin gauge sheets and still more particularly to coolant applying devices for said rolling mills.

2. Description of the Prior Art:

Prior coolant applying devices used on rolling mills have arranged elongated manifolds parallel with the work and backup rolls of the rolling mill and directed fluids, such as kerosene, through individual spray nozzles on the manifolds against the rolls of the mills to provide temperature control and lubrication during the rolling operation.

The most pertinent prior art comprise my U.S. Pat. Nos. 4,568,026 of Feb. 4, 1986; 4,733,696 of Mar. 29, 1988, and 4,733,697 of Mar. 29, 1988, in which pilot operated control valves in manifold assemblies are disclosed and in which the coolant control valves controlling the spray nozzles are removable cartridge-like assemblies postioned in the coolant manifold and controlled by solenoid actuated pilot valves in the cartridge assemblies or immediately adjacent thereto.

The pilot operated coolant control valves of these patents have been very successful commercially and widely adopted by the rolling mill operators primarily concerned with rolling aluminum.

The location of the solenoid actuated pilot valves in the cartridge assemblies or immediately adjacent thereto and the coolant fluid, usually kerosene, subjects these prior art solenoid actuated pilot valves to the likelihood of damage and malfunction and the possibility of fire in the event of failure in the electrical energizing systems and/or the solenoid coils, etc. thereof.

The present invention comprises a substantial improvement in eliminating the likelihood of damage and malfunction and the possibility of fire in the event of failure in the electrical energizing systems of the prior art by substituting simplified coolant control valves for the cartridge assemblies of the prior art and positioning them in openings in a first wall of the coolant manifold and remotely positioning the solenoid operated pilot valves in an adjacent second body member so as to separate the same from the coolant control valves and the coolant in the coolant manifold which is pressurized.

Communication of pressurized coolant in the coolant manifold is established with the solenoid actuated pilot valves in their remote location so that control of the communication channels by the pilot valves safely and efficiently controls the coolant control valves and avoids the possibility of malfunction and the possibility of fire.

Applicant's present invention allows for positioning point of use control of coolant valves and reducing the cost and complexity of installation and repair time normally required, as for example in my earlier U.S. Pat. No. 4,733,639, by eliminating dependence on an air supply and communication channels by which the solenoid actuated pilot valves controlled the operation of the coolant control valves and substituting a simple control of pressurized coolant for actuating the same.

SUMMARY OF THE INVENTION

A pilot operated multiple coolant control valve assembly for use in rolling mills provides for a series of coolant control valves and associated pilot valve controls to be positioned in a single assembly at the point of use. Each of the coolant control valves is controlled independently by a solenoid operated pilot control valve remotely positioned with respect to each of the coolant control valves and arranged to control the coolant control valves by controlling the flow of the fluid coolant thereto. The fluid actuated coolant control valves and their remote solenoid actuated fluid controlling pilot valves provide unusually safe reliable operation in a difficult and dirty environment by isolating the pilot control valves and the fluid control valves in a housing manifold.

DESCRIPTION OF THE PREFERRED EMBODIMENT

Figure 1:
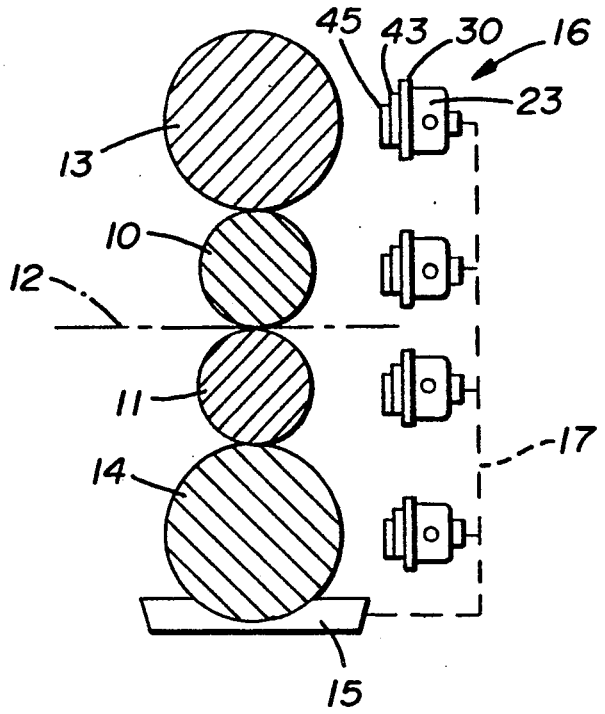
FIG. 1 is a symbolic illustration of a pair of work rolls and associated backup rolls of a rolling mill with a fluid collecting trough therebelow and several fluid spraying manifold assemblies therebeside.

By referring to FIG. 1 of the drawings, it will be seen that a diagrammatic illustration of a rolling mill discloses superimposed work rolls 10 and 11 engaged on a pass line 12 and having backup rolls 13 and 14 as will be understood by those skilled in the art. Such rolling mills are used in reducing metal billets to continuous hot or cold rolled strip and/or sheet. Means for driving the rolls is not illustrated.

A coolant collection trough 15 is shown and four vertically spaced coolant control valve manifold assemblies 16 are shown positioned in spaced relation to the work rolls 10 and 11 and the backup rolls 13 and 14. Means for circulating a coolant fluid, such as kerosene, from the collecting trough 15 to the manifold assemblies 16 is indicated by broken lines 17.

Figure 2:
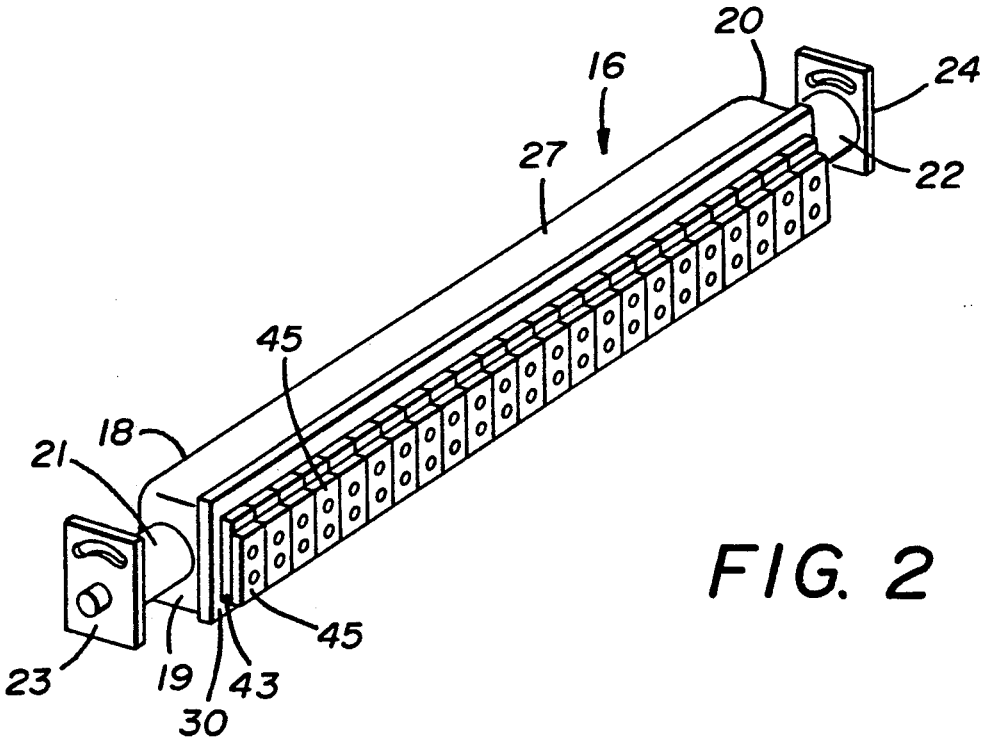
FIG. 2 is a perspective elevation of a plurality of coolant control valves in a manifold assembly.

By referring to FIG. 2 of the drawings, a perspective elevation of one of the coolant valve manifold assemblies 16 may be seen and it is formed of an elongated housing 18 closed at its ends 19 and 20 and provided with end extensions 21 and 22 including mounting and adjustment plates 23 and 24.

Figure 3:
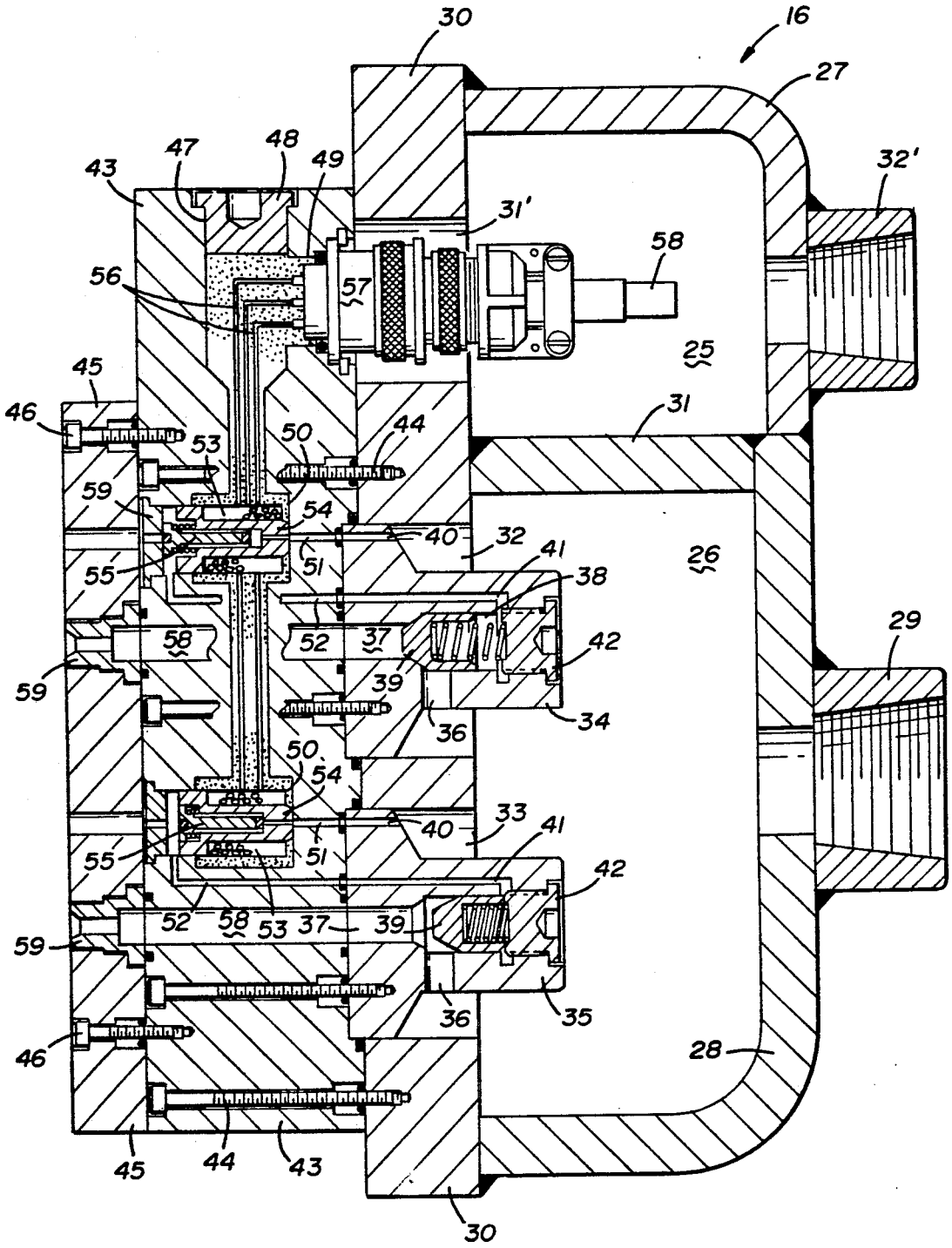
FIG. 3 is an enlarged cross sectional elevation transversely of the control valve and manifold assembly of FIG. 2 with parts broken away and parts in cross section and illustrating the fluid control valves in normally closed position.

By referring now to FIG. 3 of the drawings, it will be seen that the housing 18 forms two elongated chambers 25 and 26, respectively, which are formed by upper and lower cross sectionally L-shaped body members 27 and 28, respectively. Inlet ports 29 communicate with the elongated chamber 26 for the introduction of liquid coolant thereinto, such as kerosene, from a suitable supply source at operating pressures which may vary between 30 and 200 PSI. The elongated chambers 25 and 26 are closed by a vertically positioned body member 30 and the chambers 25 and 26 are separated by a horizontal partition 31. The body members 26 and 27 and 30 and 31 are secured to one another by welding.

Still referring to FIG. 3 of the drawings, it will be observed that the vertically positioned body member 30, which extends continuously along the elongated chambers 25 and 26 and forms one wall thereof, has a plurality of openings therein comprising a horizontally disposed row of openings 31' which communicate with the elongated chamber 25 and two vertically spaced rows of openings 32 and 33, respectively, the openings 32 and 33 being in vertical alignment and in communication with the elongated chamber 26 in which the pressurized fluid coolant is maintained. Two rows of coolant control valves 34 and 35, respectively, are positioned in the rows of openings 32 and 33, respectively, and each of the coolant control valves 34 has an inlet port 36 and an outlet port 37 which communicate with a valve chamber 38 in which a spring urged valve element 39 is reciprocably positioned so as to control fluid flowing between the inlet port 36 and the outlet port 37. Each of the coolant control valves 34 also has a pair of communication passageways 40 and 41, the passageway 40 communicating with the pressurized coolant in the elongated chamber 26 and the passageway 40 establishing communication with the valve chamber 38. Both the communicating passageways 40 and 41 extend to the surface of the coolant control valve 34 oppositely disposed with respect to the elongated channel 26. Each of the coolant control valves 35 are duplicates of the coolant control valves 34 and have the same inlet and outlet ports 36 and 37, the same valve chamber 38, valve elements 39 and the communicating passageways 40 and 41 as hereinbefore described in connection with the coolant control valves 34. Each of the coolant control valves 34 and 35 has a plugged opening 42 so that the valve chambers 38 directly communicate with the fluid coolant in the elongated chamber 26 only through the inlet ports 36.

Still referring to FIG. 3 of the drawings, it will be seen that a pilot valve mounting body 43 is attached to the vertically positioned body member 30 by a plurality of fasteners 44 and that a nozzle plate assembly 45 is mounted on the pilot valve mounting body 43 by a plurality of fasteners 46.

The pilot valve mounting body 43 has a vertical bore 47 therein which is plugged at its upper end by a plug 48 above a sideward extension 49 which communicates with one of the openings 31 in the horizontally disposed row of openings communicating with the elongated chamber 25. The vertical bore 47 extends downwardly in the pilot valve mounting body 43 so as to communicate with two cavities 50 which in turn communicate with passageways 51 and 52, the passageways 51 communicating with the communicating passageways 40 in the coolant control valves 34 and 35 and the passageways 52 communicating with the passageways 41 in the coolant control valves 34 and 35.

Solenoid coils 53 positioned around sleeves 54 containing longitudinally slotted solenoid plungers 55 are disposed in each of the cavities 50 in the pilot valve mounting body 43 and are connected with electrical conductors 56 which extend through the vertical bore 47 and in turn connect with an electrical connection plug 57 in each of the openings 31 in the horizontally disposed row of such openings which communicate with the elongated chamber 25 which forms a raceway for cables 58 which lead to the access ports 32' and to a suitable power source and control switches as hereinbefore described. The solenoids are encapsulated in resin.

The cavities 50 are closed by plugs 59 which are centrally apertured and sealingly engaged in the cavities 50 in spaced relation to the ends of the sleeves 54 so as to form chambers 60 therebetween. The adjacent ends of the sleeves 54 have enlarged circular areas therein which in effect enlarge the chambers 60. The longitudinally slotted solenoid plungers 55 have enlarged ends 61 which are movable into and out of the enlarged areas in the ends of the sleeves 54. Coil springs are disposed around the adjacent portions of the longitudinally slotted solenoid plungers 55 so as to engage the enlarged ends 61 and the opposing surfaces of the enlarged areas in the sleeves 54 so as to urge the longitudinally slotted solenoid plungers 55 outwardly of the solenoid coils 53 when the solenoids are de-energized. The longitudinally slotted solenoid plungers 55 have secondary valve elements comprising resilient seals in each of their opposite ends, one of which will engage and close the aperture in the center of the plug 59 when the solenoid is de-energized and the other of which will engage and close the passageway 51 which extends through the pilot valve mounting body 43 and the adjacent end portion of the longitudinally slotted solenoid plunger 55. When the solenoid plunger 55 is in the position illustrated in the upper portion of FIG. 3 of the drawings, fluid pressure from the elongated chamber 26 in which the pressurized coolant fluid is present will flow through the communicating passageway 40 in the coolant control valve 34, the passageway 51 in the pilot valve mounting body 43 and through the communicating passageway in the end of the sleeve 54 and then through the longitudinal slots in the surface of the solenoid plunger 55 and into the chamber 60 from whence it will flow through the passageway 52 in the pilot valve mounting body 43 and the communicating passageway 41 in the coolant control valve 34 and into the valve chamber 38 where it will move the valve element 39 into closed position with respect to the outlet port 37 thus stopping the flow of coolant.

It will be understood by those skilled in the art that when the solenoid coil 53 is energized, the longitudinally slotted solenoid plungers 55 will move inwardly of the sleeves 54 within the solenoid coils 53 and as illustrated in the lower one of the solenoid operated pilot valves in FIG. 3 of the drawings, will move the seal in its inner end against the passageway in the adjacent end of the sleeve 54 and effectively close communication with the passageway 51 in the pilot valve mounting body and the passageway 40 in the coolant control valve 35. When this occurs, the pressurized coolant in the elongated chamber 26 and the inlet port 36 of the coolant control valve 35 will move the valve element 39 by reason of its end configuration exposed to the inlet port 36 whereupon the pressurized coolant from the elongated chamber 26 will flow through the outlet port 37 and into a communicating outlet port passageway 58 in the pilot valve mounting body 43 which in turn communicates with a spray nozzle 59 mounted in the nozzle plate assembly 45. Those skilled in the art will observe that each of the two spray nozzles in each of the plurality of nozzle plate assemblies 45 as seen in FIG. 2 of the drawings, in each of the manifolds and its valve assemblies of FIG. 1 of the drawings, are thus subject of instantaneous remote control by reason of the solenoid operated pilot valves controlling the fluid pressure operation of the coolant control valves as hereinbefore described.

It will also be seen that in the form of the invention illustrated in FIG. 3 of the drawings and hereinbefore described, the normally closed design results in a fail-safe operation in the event of electrical failure in the control system as the springs around the ends of the longitudinally slotted solenoid plungers 55 will upon de-energization of the solenoid, close the communication passageways between the pressurized coolant in the elongated chamber 26 with respect to the coolant control valves and their valve elements 39, which responsive to springs 60 will immediately close the valve elements 39 with respect to the inlet ports 36.

Those skilled in the art will also observe that such automatic closure of the solenoid operated pilot valves and the resulting closure of the coolant control valves, eliminates flow of flammable coolant fluid, such as kerosene, through the solenoid operated pilot valves and greatly reduces the chances of fire in an adjacent rolling mill and in proximity to the device of the invention as would otherwise occur.

It will occur to those skilled in the art that the design of the disclosed invention may be modified so that the coolant control valves are normally open as may be desirable in some rolling mill applications wherein it is essential that a continuous supply of coolant fluid and its capability of providing lubrication between the work rolls and the material being rolled continue to prevent damage to the material being rolled as well as the work rolls and backup rolls, etc. This is particularly true in continuous rolling mill instrallations.

Figure 4:
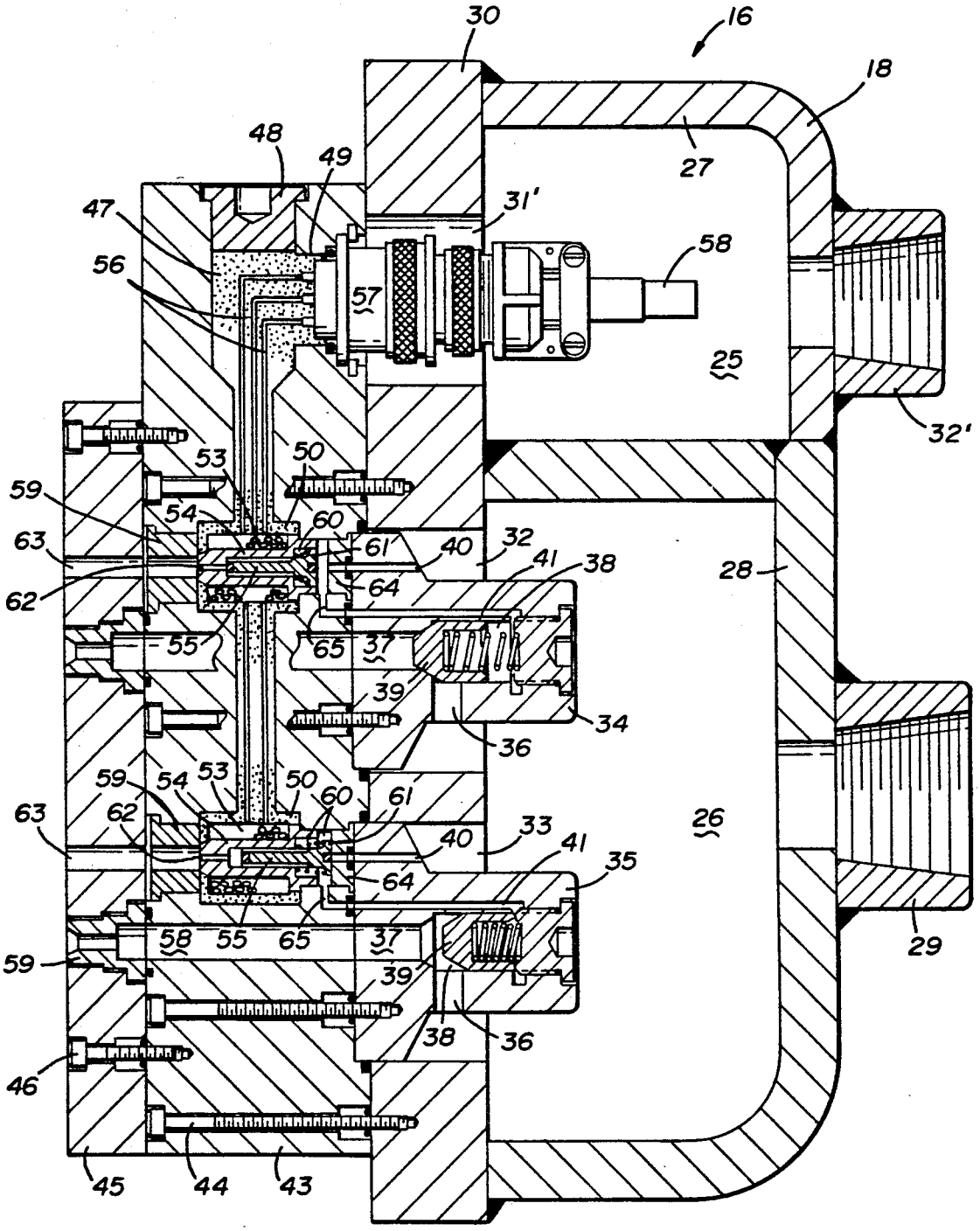
FIG. 4 is an enlarged cross sectional elevation transversely of the control valve and manifold assembly of FIG. 2 with parts broken away and parts in cross section and illustrating fluid control valves in normally open position.
Figure 5:
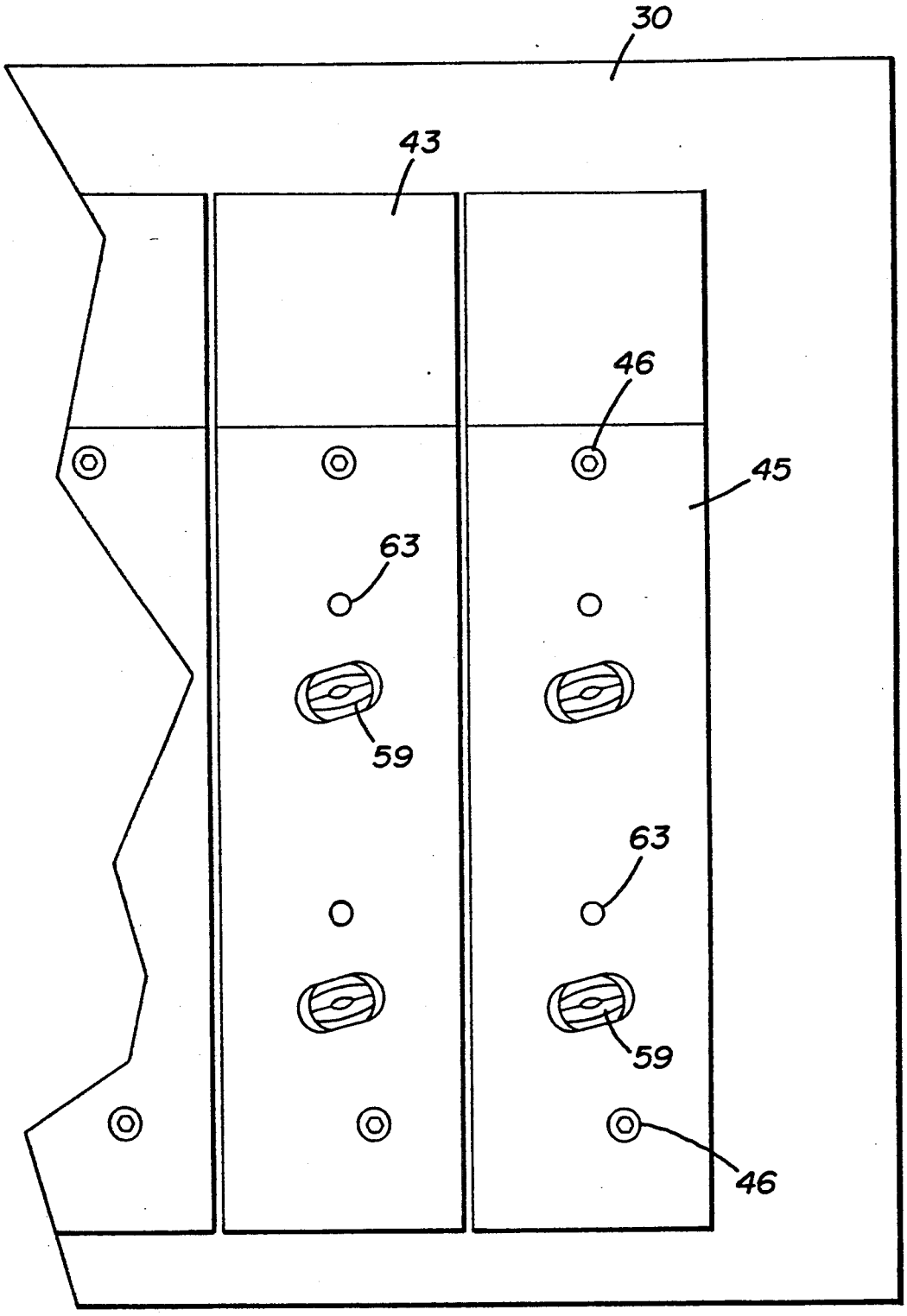
FIG. 5 is a front plan view on an enlarged scale of a portion of the plurality of coolant control valves on a manifold assembly of FIG. 2.

By referring to FIG. 4 of the drawings, a modification providing normally open coolant control valves upon failure of a control system may be seen.

In FIG. 4 of the drawings, the manifold assembly 16 is illustrated as consisting of an elongated housing 18 which is formed by body members 27 and 28 and a partition 31 to define an elongated chamber 25 and a second elongated chamber 26. An inlet port 29 communicating with the chamber 26 supplies liquid coolant, such as kerosene, under pressure to the elongated chamber 26 while the elongated chamber 25 forms an electrical conductor raceway.

In FIG. 4 of the drawings, the elongated chambers 25 and 26 are completed by a vertically positioned body member 30 in which a plurality of openings 31, 32 and 33 are arranged in three vertically spaced rows. Coolant control valves 34 and 35 are positioned in each of the plurality of openings 32 and 33 in the vertically positioned body member 30 and inlet ports 36 and outlet ports 37 are formed in the coolant control valves 34 and 35 and communicate with valve chambers 38 therein in which valve elements 39 are movably positioned so as to control the flow of fluid coolant between the inlet ports 36 and the outlet ports 37. There are communicating passageways 40 and 41 in each of the plurality of coolant control valves 34 and 35, which communicate with the fluid coolant in the elongated chamber 26 and with connecting passageways in pilot valve mounting bodies 43 which are secured to the vertically positioned body members 30 by fasteners 44. Nozzle plate assemblies 45 are secured to each of the plurality of pilot valve mounting bodies 43, one of each being illustrated in FIG. 4 of the drawings, like FIG. 3 of the drawings, the nozzle plate assemblies being secured to the pilot valve mounting bodies 43 by fasteners 46. A vertical bore 47 is formed in each of the pilot valve mounting bodies 43 and it is closed at its upper end by a plug 48 immediately above a sideward extension 49 which communicates with one of the openings 31 in the horizontally disposed row of openings communicating with the elongated chamber 25. The vertical bore 47 extends downwardly in the pilot valve mounting body 43 so as to communicate with two cavities 50 which in turn communicate with passageways 51 and 52 in the pilot valve mounting body 43, the passageways 51 communicating with the communicating passageways 40 in the coolant control valves 34 and 35 and the passageways 52 communicating with the passageways 41 in the coolant control valves 34 and 35.

Solenoid coils 53 positioned around sleeves 54 containing longitudinally slotted solenoid plungers 55 are disposed in each of the cavities 50 in the pilot valve mounting body 43 and are connected with electrical conductors 56 which extend through the vertical bore 47 and in turn connect with an electrical connection plug 57 in each of the openings 31 in the horizontally disposed row of such openings which communicate with the elongated chamber 25 which forms a raceway for cables 58 with lead to the access ports 32 and to a suitable power source and control switches as known in the art.

Cavities 50 are closed by plugs 59 which are centrally apertured and sealingly engaged in the cavities 50 so as to communicate with passageways in the ends of the sleeves 54 which are in contact therewith and which in turn communicate with the longitudinally slotted solenoid plungers 55 and chambers 60 in the opposite ends of the sleeves 54, the chambers 60 having enlarged areas in the sleeves 54.

Annular flanges 61 are formed on the ends of the longitudinally slotted solenoid plungers 55 so as to be movable in the chambers 60. Springs are positioned between the annular flanges 61 and the oppositely disposed surfaces of the enlarged chamber 60 so that the longitudinally slotted solenoid plungers 55 are normally urged toward the chambers 60 and outwardly of the solenoid coils 53. The longitudinally slotted solenoid plungers 55 have secondary valve elements comprising resilient seals in each of their opposite ends, one of which will engage and close an axial bore 62 in the opposite of the sleeve 54, the bore 62 communicating with the central aperture in the plug 59 and in turn with a vent passageway 63 in the nozzle plate assembly 45, as seen in FIG. 4 of the drawings.

Still referring thereto, it will be seen that when the solenoid coil 53 in the upper solenoid in the pilot valve mounting body 43 of FIG. 4 of the drawings is energized, the longitudinally slotted solenoid plunger 55 therein will move to the left and move the seal in its left end into engagement with the bore 62. At the same time, the seal in the other end of the longitudinally slotted solenoid plunger 55 will move away from an aperture in a second plug 64 which communicates with the communicating passage 40 and thereby with the pressurized fluid coolant in the elongated chamber 26. The pressurized coolant fluid accordingly moves into the chamber 60 and downwardly therefrom through a passageway 65 which communicates with the communicating passageway 41 in the coolant control valve 34 and extends to the coolant control valve chamber 38 therein and moves the valve element 34 into sealing engagement with the outlet port 37 stopping the flow of pressurized coolant fluid through the coolant control valve 34. At such time as the solenoid coil 53 is de-energized, the longitudinally slotted solenoid plunger 55 moves in the opposite direction as seen in the lower solenoid operated pilot valve in the pilot valve mounting body 43 in FIG. 4 of the drawings.

By referring thereto, it will be seen that when this occurs, the aperture in the second plug 64 is closed by the seal in the end of the solenoid plunger and thus coolant fluid from the elongated chamber 26 can no longer enter the chamber 60. Simultaneously, the seal in the other, left end, of the longitudinally slotted solenoid plunger 55 moves away from the bore 62 in the sleeve 54 and establishes communication with the vent passageway 63 in the nozzle plate assembly 45 so that the pressure previously in the solenoid operated pilot valve is exhausted to atmosphere by way of the longitudinal slots in the solenoid plunger 55, the chamber 60, the passageway 65 and the communicating passageway 41 whereupon the pressurized coolant fluid in the elongated chamber 26 and the inlet port 36 moves the valve element 39 to open position and establishes communication with the passageway 37 which extends through the passageway 58 in the pilot valve mounting body 43 and therefore into the spray nozzle 59 in the nozzle plate assembly 45.

It will be seen that when the solenoid in the solenoid operated pilot valves in the form of the invention illustrated in FIG. 4 of the drawings and hereinbefore described are de-energized, the coolant control valves 34 and 35 automatically move to open position by the action of the pressurized coolant fluid.

Those skilled in the art of rolling mill reduction of steel, both hot and cold rolled, will be familiar with the fact that the continuous direction of a suitable coolant, such as water, on the work and backup rolls of the rolling mills controls the temperature of the work rolls and thereby insures the maintenance of a desirable gauge of the metal being rolled. A desired coolant temperature easily maintained with the present system is between 90° F. and 160° F. with coolant pressure supplied the plurality of spray nozzles 59 at varying desirable pressures, such as 150 PSI. The nozzles 59 are preferably arranged for indexing at 15° from a transverse center line so as to insure complete coverage of the work and backup rolls of the rolling mill on which the device is used.

It will thus be seen that substantially improved pilot controlled liquid operated coolant control valves in a manifold assembly have been disclosed and although but two embodiments of the present invention have been illustrated and described, it will be apparent to those skilled in the art that various changes and modifications may be made therein without departing from the spirit of the invention or from the scope of the appended claims.

Having thus described my invention what I claim is:

1. In an arrangement of solenoid operated pilot valves for operating coolant control valves in a manifold assembly for supplying a pressurized coolant to a rolling mill and having apertured body members closing said manifold, wherein said coolant control valves are positioned in a first one of said apertured body members and are responsive in operation to said pressurized coolant controlled by said solenoid operated pilot valves; the improvement comprising positioning said solenoid operated pilot valves in a second one of said apertured body members spaced from said pressurized coolant by said first one of said apertured body members, each of said coolant control valves consisting of a body member having a valve chamber therein and inlet and outlet ports communicating with said valve chamber, a valve element disposed in said valve chamber for movement toward and away from said outlet port, and a spray nozzle on a third one of said apertured body members, said outlet port communicating with said spray nozzle on said third body member and said inlet port communicating with said pressurized coolant, said solenoid operated pilot valves being spaced with respect to said pressurized coolant by said first one of said apertured body members, passageways in said solenoids communicating with said pressurized coolant and said valve chambers in said coolant control valves, longitudinal slotted solenoid plungers in said passageways, seals on said longitudinally slotted solenoid plungers for opening and closing said passageways and means for actuating said solenoids whereby energization of said solenoids moves said longitudinally slotted solenoid plungers to close said passageway communicating with the pressurized coolant so as to enable said pressurized coolant to move said valve element in said valve chamber in said coolant control valves away from said outlet port and direct pressurized coolant to said spray nozzle.

2. In an arrangement of solenoid operated pilot valves for operating coolant control valves in a manifold assembly for supplying a pressurized coolant to a rolling mill and having apertured body members closing said manifold, wherein said coolant control valves are positioned in a first one of said apertured body members and are responsive in operation to said pressurized coolant controlled by said solenoid operated pilot valves; the improvement comprising positioning said solenoid operated pilot valves in a second one of said apertured body members spaced from said pressurized coolant by said first one of said apertured body members, each of said coolant control valves consisting of a body member having a valve chamber therein and inlet and outlet ports communicating with said valve chamber, a valve element disposed in said valve chamber for movement toward and away from said outlet port, and a spray nozzle on a third one of said apertured body members, said outlet port communicating with said spray nozzle on said third body member and said inlet port communicating with said pressurized coolant, said solenoid operated pilot valves being spaced with respect to said pressurized coolant by said first one of said apertured body members, passageways in said solenoids communicating with said pressurized coolant and said valve chambers in said coolant control valves, longitudinal slotted solenoid plungers in said passageways, seals on said longitudinally slotted solenoid plungers for opening and closing said passageways and means for actuating said solenoids whereby energization of said solenoids moves said longitudinally slotted solenoid plungers to open said passageway communicating with the pressurized coolant and said valve chambers in said coolant control valves so as to move said valve element in said valve chamber in said coolant valve into engagement with said outlet port and block the flow of pressurized coolant to said spray nozzle.

3. The improvement in an arrangement of solenoid operated valves for operating coolant control valves in a manifold assembly set forth in claim 1 and wherein a vertical bore is formed in said second one of said apertured body members and cavities are formed in said second body member and spaced with respect to one another and communicate with said vertical bore and wherein said solenoid operated pilot valves are positioned in said cavities, electrical conductors communicating with said solenoids extend through said vertical bore and wherein encapsulating synthetic resin is positioned in said vertical bore and said cavities to sealingly encapsulate said electrical conductors and solenoid operated pilot valves.

4. The arrangement of solenoid operated pilot valves for operating coolant control valves in a manifold assembly set forth in claim 1 and wherein elongated channels are formed in said manifold and said pressurized coolant is positioned in one of said elongated channels and wherein said coolant control valves communicate with said elongated channel and the pressurized coolant therein.

5. The arrangement of solenoid operated pilot valves for operating coolant control valves in a manifold assembly set forth in claim 4 and wherein some of said apertures are positioned in said second one of said apertured body members in communication with said one of said elongated channels and pressurized coolant therein and the remainder of said apertures are positioned in communication with another one of said elongated channels to provide conduits for electrical conductors for energizing said solenoid operated pilot valves.

6. The improvement in an arrangement of solenoid operated valves for operating coolant control valves in a manifold assembly set forth in claim 2 and wherein a vertical bore is formed in said second one of said apertured body members and cavities are formed in said second body member and spaced with respect to one another and communicate with said vertical bore and wherein said solenoid operated pilot valves are positioned in said cavities, electrical conductors communicating with said solenoids extend through said vertical bore and wherein encapsulating synthetic resin is positioned in said vertical bore and said cavities to sealingly encapsulate said electrical conductors and solenoid operated pilot valves.

7. The arrangement of solenoid operated pilot valves for operating coolant control valves in a manifold assembly set forth in claim 2 and wherein elongated channels are formed in said manifold and said pressurized coolant is positioned in one of said elongated channels and wherein said coolant control valves communicate with said elongated channel and the pressurized coolant therein.

8. The arrangement of solenoid operated pilot valves for operating coolant control valves in manifold assembly set forth in claim 5 and wherein some of said apertures are positioned in said second one of said apertured body members in communication with said one of said elongated channels and pressurized coolant therein and the remainder of the apertures are positioned in communication with another one of said elongated channels to provide conduits for electrical conductors for energizing said solenoid operated pilot valves.

* * * * *